US005579713A

United States Patent [19]

Power

[11] Patent Number: 5,579,713

[45] Date of Patent: Dec. 3, 1996

[54] AUTOMATIC LEVELLING SELF BEDDING ANCHOR

[76] Inventor: Robert W. Power, 38 Leeds Road, Mount Waverley, Victoria, Australia, 3349

[21] Appl. No.: 521,688

[22] Filed: Aug. 31, 1995

[30] Foreign Application Priority Data

Sep. 6, 1994 [AU] Australia ..... PM7911

[51] Int. Cl.[6] ..... B63B 21/38

[52] U.S. Cl. ..... 114/304

[58] Field of Search ..... 114/296, 297, 114/298, 299, 300, 301, 304, 302, 303

[56] References Cited

U.S. PATENT DOCUMENTS

| | | | |
|---|---|---|---|
| 2,994,292 | 8/1961 | Winslow | 114/298 |
| 3,463,112 | 8/1969 | Zakaitis et al. | 114/298 |
| 3,491,712 | 1/1970 | Ross | 114/298 |
| 4,005,671 | 2/1977 | Ogle | 114/298 |
| 4,230,062 | 10/1980 | Fornasiero | 114/297 |

*Primary Examiner*—Stephen Avila
*Attorney, Agent, or Firm*—Richard M. Goldberg

[57] ABSTRACT

An automatic levelling self-bedding anchor having a high capacity for levelling and an improved capacity for positioning and bedding, which comprises:

1. an elongated shank (5);
2. a cam plate (6) with pivot (7), connected to the shank at or near to one end of the shank;
3. a gusset plate (4) connected to the shank through the cam plate pivot;
4. a fluke limit means (3) connected to the gusset plate adapted to retain the fluke pivot shaft, whereby the limit means retaining the pivot shaft controls the travel of the flukes to one side or the other side of the shank;
5. two flukes (1, 1A) connected to the pivot shaft, one on each side of the shank, the point of each fluke being located relatively far from the shank and approximately in line with the respective end of the pivot shaft; and
6. cam means (6) connected to the shank and adapted to interact with a cam surface or cam surfaces (8) on one or both flukes, wherein the flukes may be retained in a desired bedding position.

9 Claims, 7 Drawing Sheets

AUTOMATIC LEVELLING SELF BEDDING ANCHOR

FIELD OF THE INVENTION

This invention relates to an automatic levelling, self-bedding anchor having a high capacity for levelling and bedding.

BACKGROUND OF THE INVENTION

Many types of anchors for use in small boats suffer from a number of inadequacies, in essence a failure to level and bed in a range of seabed conditions and operating positions. One type of anchor in common use comprises an elongated shank to which is attached a straight pivot shaft at one end of the shank. Flat flukes are connected to the pivot shaft, one on each side of the shank. Each fluke is shaped to form a point located close to the shank. A limit means is supplied to control the travel of the flukes through a single pivot from one bedding position on one side of the shank to a second position on the other side. Three major problems with this type of anchor are, firstly, there is a tendency for it to fail to bed and to skid over the surface of the seabed. Secondly, there is a tendency to prop on one end of the pivot shaft and drag, failing to level and drop into a bedding position. Thirdly, there is a tendency to break out from the sea bed after bedding because the load through the fluke tips is concentrated on a small area of seabed.

It is an object of the present invention to provide an anchor which will level with a very high degree of certainty, self position for bedding, and remain level in position for bedding.

BRIEF SUMMARY OF THE INVENTION

This invention relates to an automatic levelling self-bedding anchor having a high capacity for levelling and an improved capacity for positioning and bedding, which comprises:

1. an elongated shank;
2. a cam plate with pivot, connected to the shank at or near to one end of the shank;
3. a gusset plate connected to the shank through the cam plate pivot;
4. a fluke limit means connected to the gusset plate adapted to retain the fluke pivot shaft, whereby the limit means retaining the pivot shaft controls the travel of the flukes to one side or the other side of the shank;
5. two flukes connected to the pivot shaft, one on each side of the shank, the point of each fluke being located relatively far from the shank and approximately in line with the respective end of the pivot shaft; and
6. cam means connected to the shank and adapted to interact with a cam surface or cam surfaces on one or both flukes, wherein the flukes may be retained in a desired bedding position.

BRIEF DESCRIPTION OF THE DRAWINGS

The accompanying drawings illustrate several embodiments of the invention.

Thus.

DETAILED DESCRIPTION OF THE INVENTION

It is desirable that the gusset plate be provided with notch means on that edge adjacent the end of the elongated shank whereby the shank may drop into selected regions of the notch means to limit its travel.

Each fluke is preferably substantially flat. In a preferred embodiment a fold or swage may be formed laterally, longitudinally or transversely in each fluke to improve the strength of the flukes. One fluke may be joined to another fluke to form a single structure.

In another embodiment the bifurcated cam plate may be two separate cam plates connected to the elongated shank.

The limit means conveniently comprises limit arms located on each side of the anchor, each arm extending generally in line with the shank and outwardly from the shank and towards the free end of the shank.

The cam means preferably comprises a sub-cam means associated with each fluke, each fluke being provided with a camming surface for interaction with a corresponding sub-cam means.

Figure 1:
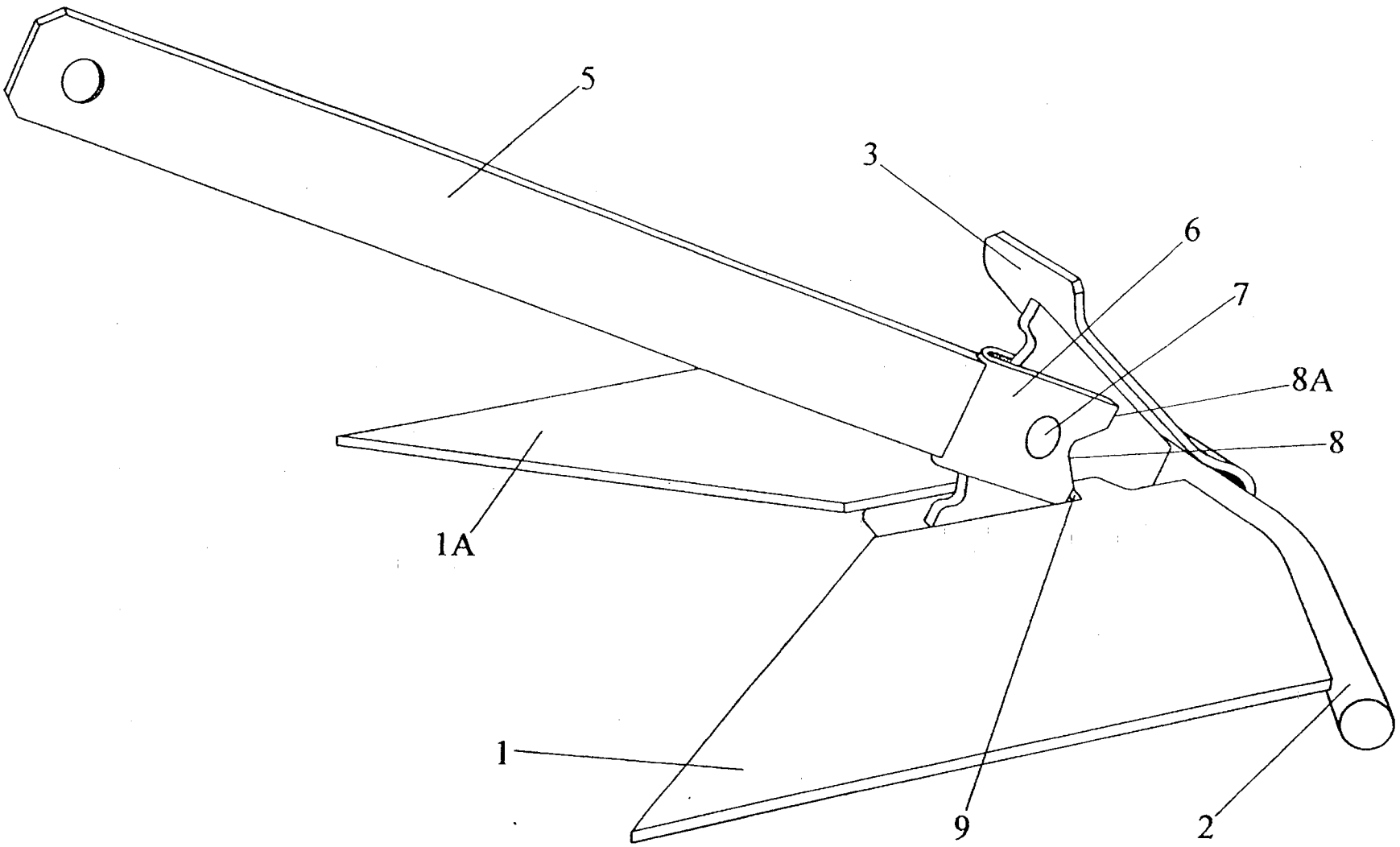
FIG. 1 is an isometric view from one side and above of one embodiment of the invention.
Figure 2:
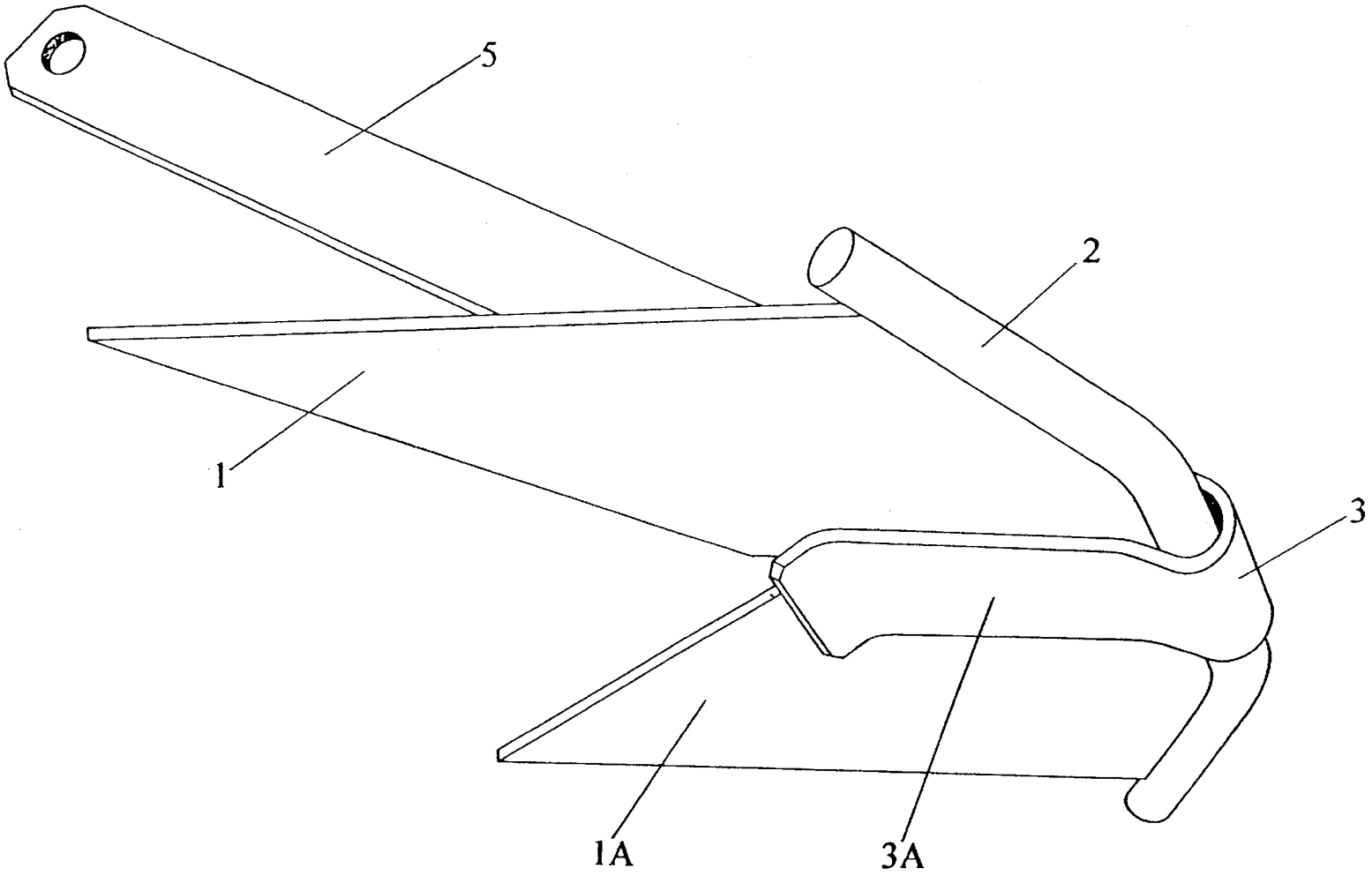
FIG. 2 is an isometric view from one side and below of the embodiment of FIG. 1.
Figure 3:
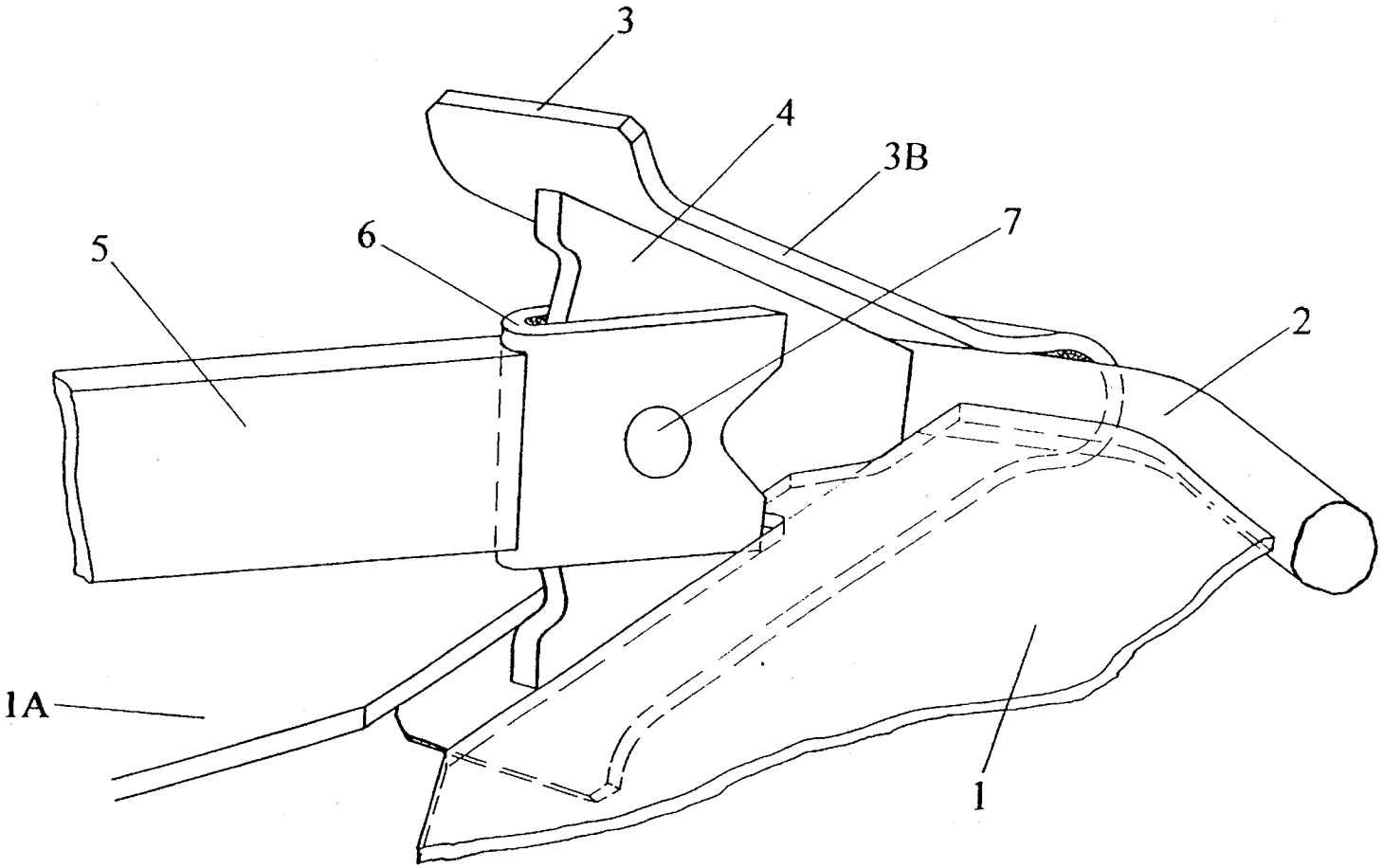
FIG. 3 is a side view of the embodiment of FIGS. 1 and 2 showing the internal relationship of certain integers by the use of ghost lines.

Turning to the accompanying drawings, in FIGS. 1 to 3 inclusive numerals 1 and 1A indicate flukes connected to a pivot shaft 2. A limit means 3 comprises limit arms 3A and 3B connected to a gusset plate 4, in turn retaining the pivot shaft 2. The gusset 4 extends internally between limit arms 3A and 3B. A shank 5 in the form of an elongated flat bar terminates in a bifurcated cam plate 6. A pivot pin 7 extends through both arms of the bifurcated cam plate 6 and gusset 4. A female cam surface 8 is formed at the end of each arm of cam plate 6. Rest surfaces 8A are formed on either side of female cam surface 8.

The female cam surface 8 and the rest surface(s) 8A interact with male cam surface 9 on a lug of each fluke 1. The anchor is shown with flukes 1 and 1A in the rest position.

Figure 4:
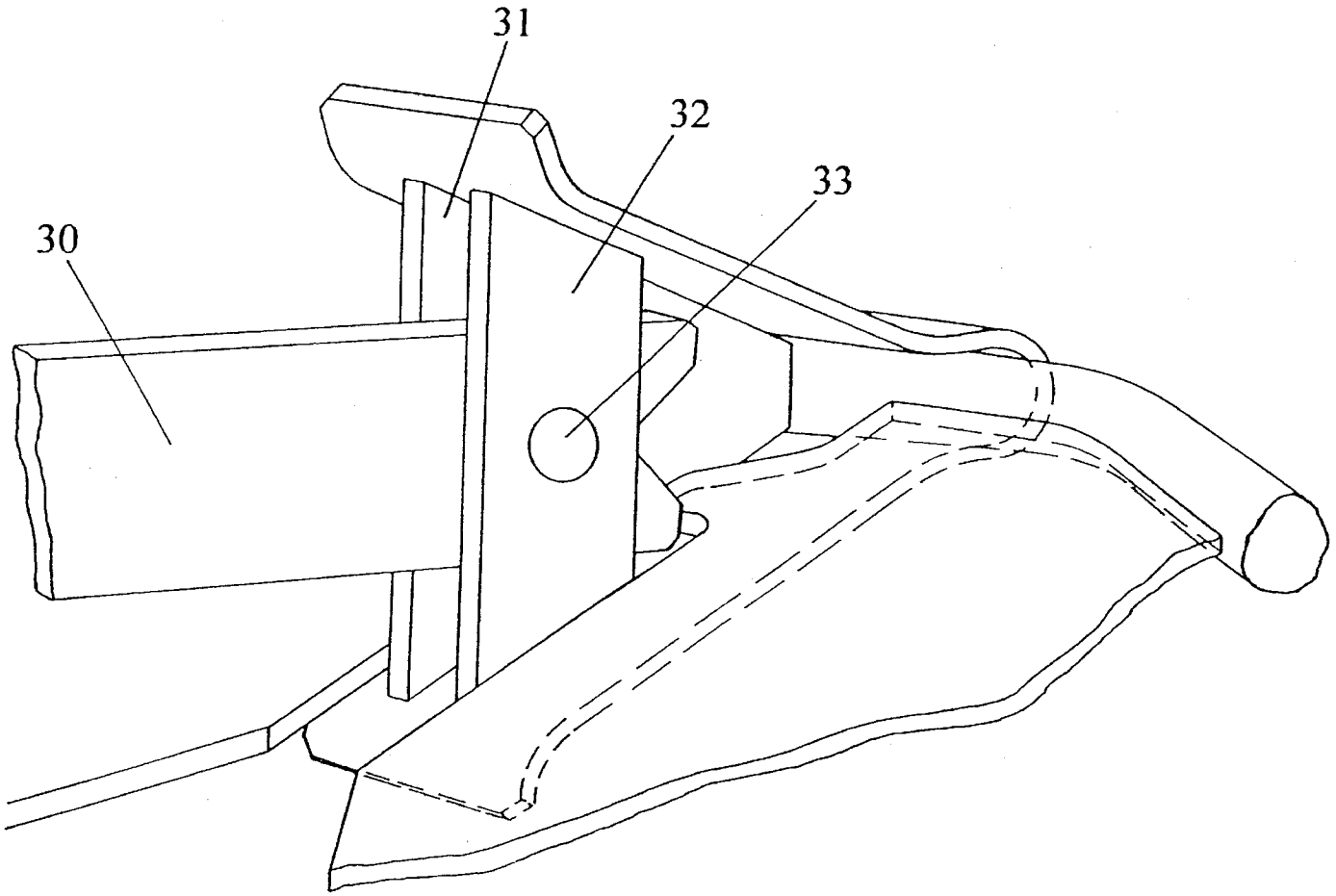
FIG. 4 is a view similar to that of FIG. 3 except that an alternative camming and pivot arrangement is illustrated.

In FIG. 4, a simplified shank 30 is shown without a bifurcated cam means. Thus shank 30 extends between complementary gussets 31 and 32, the assembly being joined by pivot pin 33.

Figure 5:
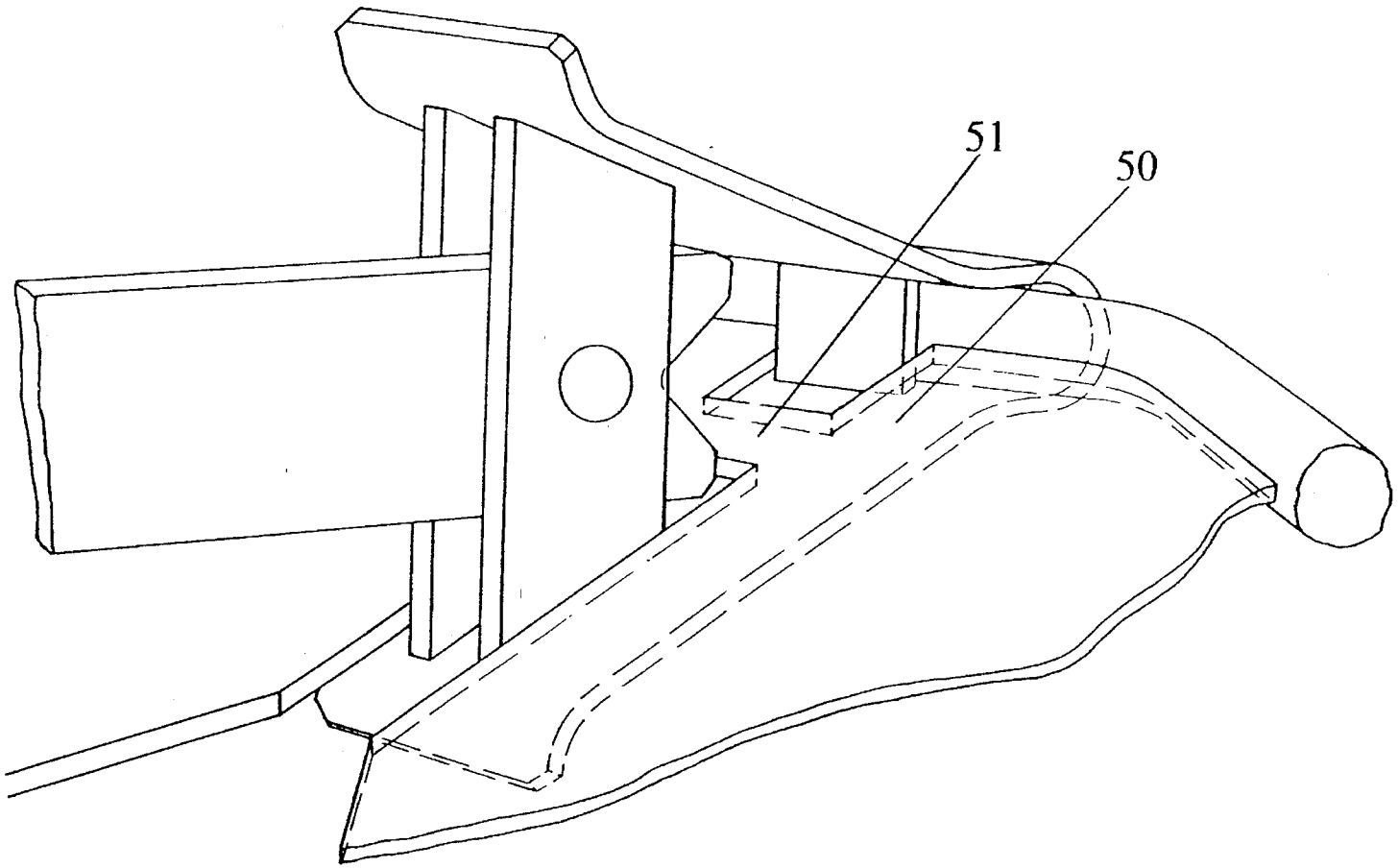
FIG. 5 is a view similar to that of FIGS. 3 and 4 except that another alternative camming and pivot arrangement is illustrated.

In FIG. 5, a single fluke body 50 is shown in which each individual fluke is joined to the other by way of bridging member 51 forming part of the fluke body.

Figure 6:
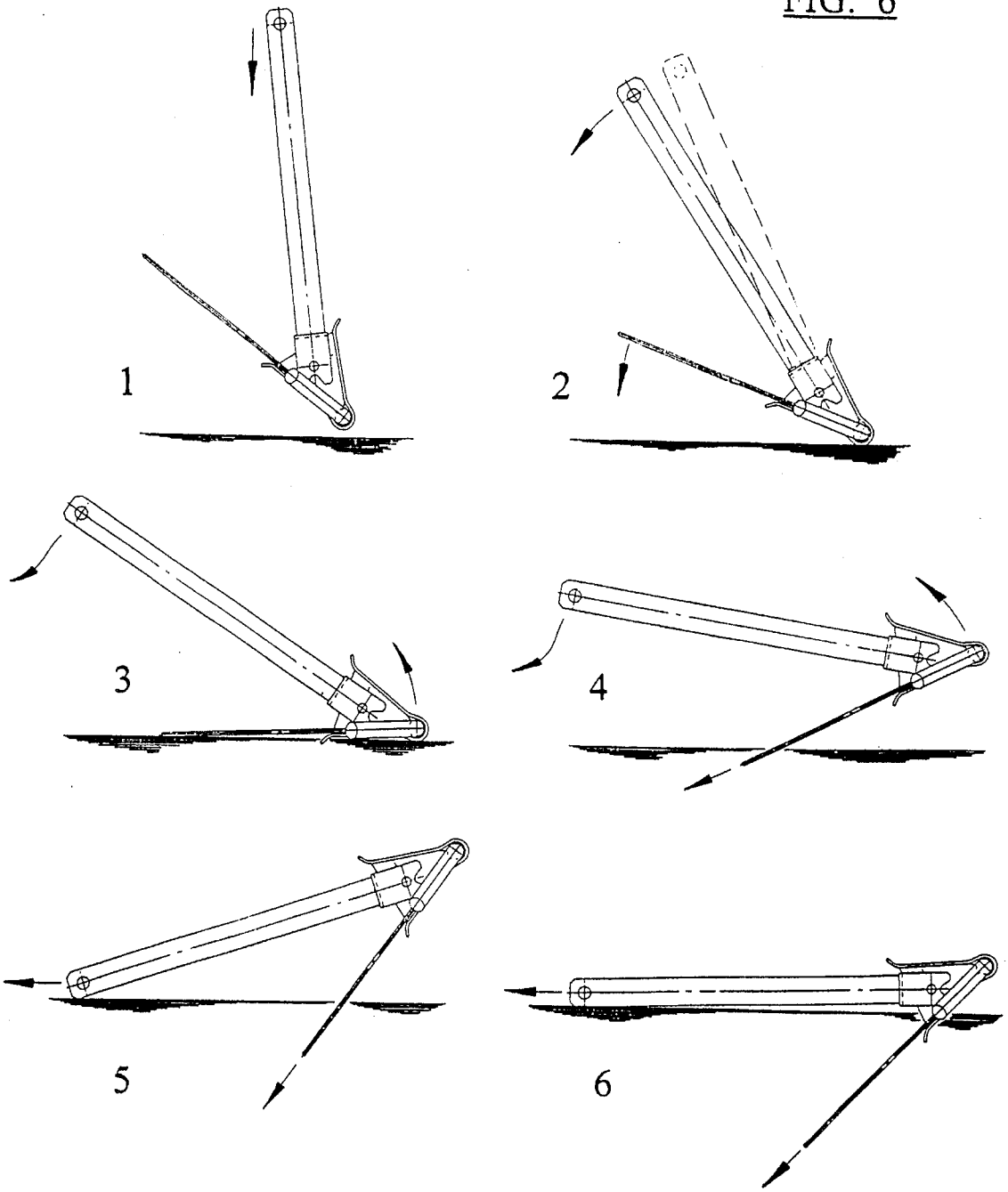
FIG. 6 is a series of side views labelled 1 to 6 representing bedding of an anchor according to the invention in the so-called "static" mode.

Turning to FIG. 6, views 1 to 6 show the operation of an anchor according to the invention in the so-called "static" mode. This is where one of the rest surfaces on the camming means is utilised. Thus the anchor is lowered onto the seabed and then dragged in a horizontal direction so that it beds. Thus the pivot shaft and associated integers rotate upwards (view 3 and 4) and then travel downwards as the flukes bed (views 5 and 6).

If desired, the pivot shaft may be reinforced at any suitable region, for example, near the central region to increase its bending moment under load. This reinforcement may have provisions for attachment of a trip line.

In smaller anchors such an attachment for a trip line may be connected to the limit means.

The static position of the anchor is operator selectable and allows the anchor to bed instantly by optimising the load vector to the angle of inclination of the shank, enabling the operator to position and anchor the craft with accuracy and reliability. It is also advantageous when anchoring in weed since the anchor beds immediately, eliminating the weed clogging drag experienced with conventional anchors. When the vessel loads the anchor, it causes the anchor to pivot on the tips of its flukes penetrating and bedding as it rotates without dragging. The flukes are retained in position by the shank cam plate. This result is achieved in practice by two methods of use. The first method is by lowering the anchor into the water and allowing it to glide to the seabed. When the anchor touches the bottom the flukes will automatically be retained by the shank cam plate, as the shank pivots downwards into the set position. The second method is initiated after the anchor has descended to the seabed (if not lowered as in the first method) and lying in the dynamic mode. The operator needs only to apply enough force to the anchor rope in an upward direction, to raise the shank off the bottom allowing the flukes to once again be retained by the shank cam plate.

Figure 7:
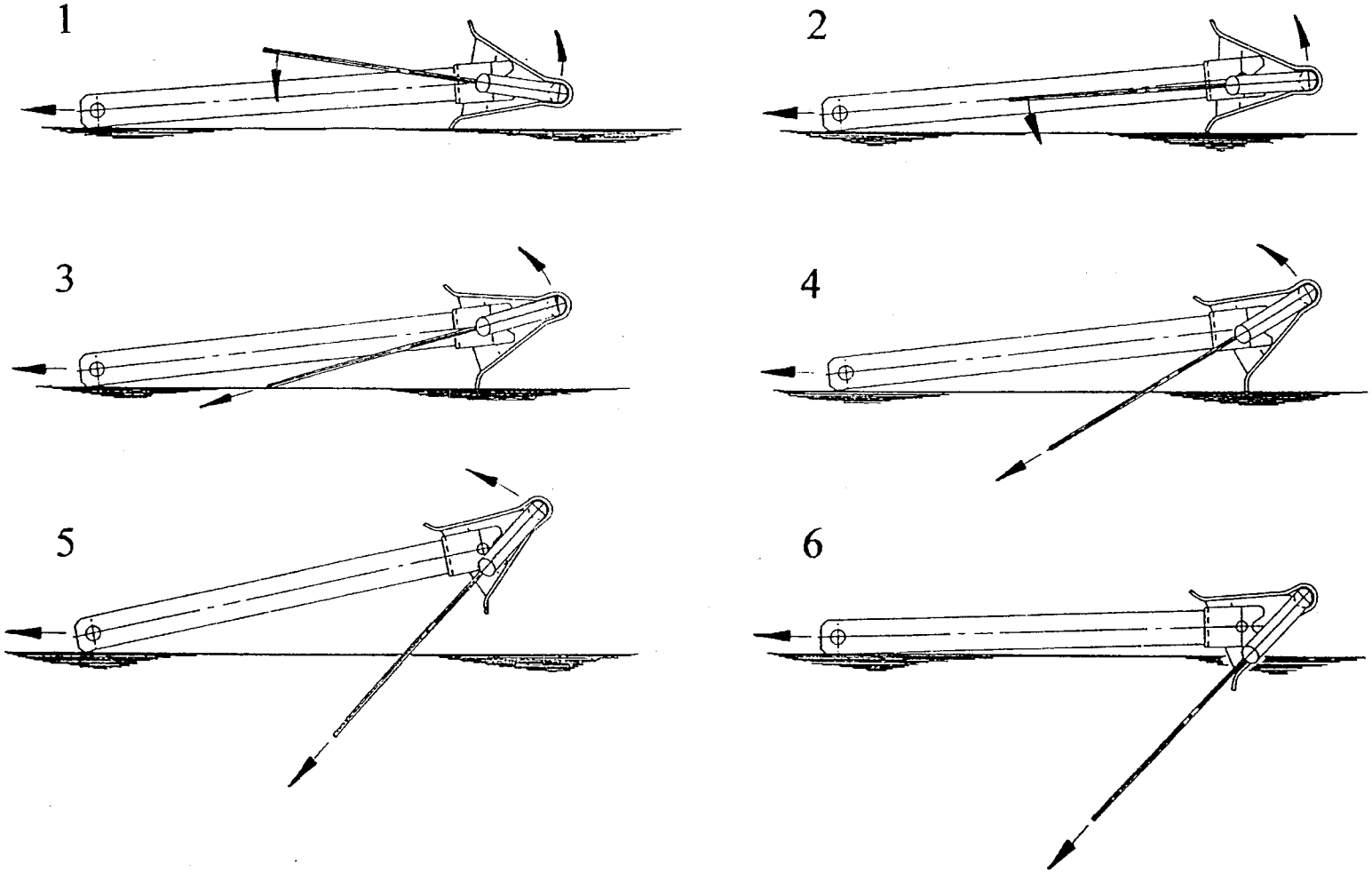
FIG. 7 is a series of side views labelled 1 to 6 representing bedding of an anchor according to the invention in the so-called "dynamic" mode.

As shown in FIG. 7, views 1 to 6, the anchor when deployed (if not in the static mode) automatically assumes the so-called "dynamic" mode, which provides the anchor with its intelligence by automatically levelling then sensing and reacting to movement, ensuring the initial bedding of the anchor. More importantly, the dynamic mode initiates the rebedding of an unattended anchor should it become dislodged due to a change in wind or tide direction. In the dynamic mode the anchor requires the interaction of the vessel, to provide a force which pulls the anchor forward along the seabed. The anchor senses this movement and reacts by rotating its flukes downwards, and raising its attitude to the seabed by virtue of its double pivot dynamic jacking feature, assisted by the weight transfer of the flukes through the fluke lugs and shank cam plate, driving the fluke tips into the seabed immediately starting the bedding process.

The claims defining the invention are as follows; I claim:

1. An automatic levelling self-bedding anchor having a high capacity for levelling and an improved capacity for positioning and bedding, which comprises:

an elongated shank;

a gusset plate;

a first pivot for pivotally connecting said gusset plate at or near to one end of the shank along a first pivot axis;

a fluke pivot shaft having a second pivot axis different from the first pivot axis;

fluke limit means connected to the gusset plate for retaining the fluke pivot shaft for pivotal movement about said second pivot axis, whereby the limit means retaining the pivot shaft controls travel of the flukes to one side or the other side of the shank;

two flukes connected to the pivot shaft, one on each side of the shank, a point of each fluke being located relatively far from the shank and approximately in line with a respective end of the pivot shaft, and at least one fluke having a first cam surface; and cam means for releasably retaining the flukes in a desired bedding position, said cam means being connected to the shank for interacting with at least one said cam surface on at least one said fluke.

2. An anchor as claimed in claim 1, wherein the gusset plate is provided with notch means on an edge adjacent the end of the elongated shank whereby the shank may drop into selected regions of the notch means to limit its travel.

3. An anchor as claimed in claim 1, wherein each fluke is substantially flat.

4. An anchor as claimed in claim 1, wherein a fold or swage is folded at least one of laterally, longitudinally and transversely in each fluke to improve the strength of the flukes.

5. An anchor as claimed in claim 1, wherein a fluke is joined to another fluke to form a single structure.

6. An anchor as claimed in claim 1, wherein the cam plate includes two separate cam plate sections connected to the elongated shank.

7. An anchor as claimed in claim 1, wherein the limit means comprises limit arms located on each side of the anchor, each arm extending generally in line with the shank and outwardly from the shank and towards the free end of the shank.

8. An anchor as claimed in claim 1, wherein the cam means comprises a second cam surface, and each fluke is provided with a lug having said first cam surface for interaction with a corresponding second cam surface of said cam means.

9. An anchor as claimed in claim 1, wherein said cam means includes:

a female cam surface, and two spaced apart rest surfaces at opposite ends of said female cam surface, each for interacting with said at least one cam surface on said at least one fluke to releasably retain the flukes in said desired bedding position.

* * * * *